US011255093B2

(12) United States Patent
Carels

(10) Patent No.: US 11,255,093 B2
(45) Date of Patent: Feb. 22, 2022

(54) FLOATING FLOOR

(71) Applicant: CDM NV, Overijse (BE)

(72) Inventor: Patrick Carels, Overijse (BE)

(73) Assignee: CDM NV, Overijse (BE)

( * ) Notice: Subject to any disclaimer, the term of this patent is extended or adjusted under 35 U.S.C. 154(b) by 0 days.

(21) Appl. No.: 16/759,916

(22) PCT Filed: Oct. 31, 2018

(86) PCT No.: PCT/IB2018/058554
§ 371 (c)(1),
(2) Date: Apr. 28, 2020

(87) PCT Pub. No.: WO2019/087107
PCT Pub. Date: May 9, 2019

(65) Prior Publication Data

US 2021/0180333 A1 Jun. 17, 2021

(30) Foreign Application Priority Data

Oct. 31, 2017 (BE) ..... 2017/5788

(51) Int. Cl.
*E04F 15/20* (2006.01)
*E04F 15/22* (2006.01)
*E04F 15/06* (2006.01)

(52) U.S. Cl.
CPC ..... *E04F 15/20* (2013.01); *E04F 15/225* (2013.01); *E04F 15/06* (2013.01)

(58) Field of Classification Search
CPC ..... E04F 15/20; E04F 15/225; E04F 15/06
See application file for complete search history.

(56) References Cited

U.S. PATENT DOCUMENTS 2,862,255 A * 12/1958 Nelson ..... E04F 15/225 52/403.1
5,369,927 A * 12/1994 Counihan ..... E04F 15/22 52/403.1

(Continued)

FOREIGN PATENT DOCUMENTS

BE 1008695 A6 7/1996
CN 107035096 A 8/2017

(Continued)

*Primary Examiner* — Patrick J Maestri
(74) *Attorney, Agent, or Firm* — Browdy and Neimark, PLLC

(57) ABSTRACT

Floating floor (10) with at least one vibration-damping support (1) that is placed on a solid underground (5), whereby the support (1) comprises a relatively rigid support slat (3) provided with discrete vibration-damping elements (2) on one side, distributed at a regular distance from each other over the support slat (3), and whereby the support slat (3) is provided with a vibration-damping strip (4) on a second side opposite the first side extending in the longitudinal direction of the support slat (3), such that the support slat (3) is situated between the vibration-damping strip (4) and the discrete vibration-damping elements (2) that are placed between the floor (10) and the underground (5), such that the floor (10) rests on the underground (5) by means of the vibration-damping strip (4), the support slat (3) and the discrete vibration-damping elements (2), whereby no direct mutual contact is made between the support slat (3), the floor (10) and the underground (5).

23 Claims, 3 Drawing Sheets

(56) References Cited

U.S. PATENT DOCUMENTS

| | | | | | |
|---|---|---|---|---|---|
| 5,388,380 | A * | 2/1995 | Niese | E04F 15/22 | 52/403.1 |
| 5,778,621 | A * | 7/1998 | Randjelovic | E04F 15/22 | 52/376 |
| 6,055,785 | A * | 5/2000 | Counihan | E04F 15/22 | 52/403.1 |
| 2011/0107691 | A1* | 5/2011 | Attia | E04F 15/225 | 52/145 |
| 2017/0114552 | A1* | 4/2017 | Randjelovic | E04F 15/22 | |
| 2017/0159302 | A1* | 6/2017 | Gleeson | E04F 15/20 | |

FOREIGN PATENT DOCUMENTS

| | | | |
|---|---|---|---|
| DE | 102011052048 | A1 | 1/2013 |
| EP | 1231336 | A1 | 8/2002 |
| EP | 1347117 | A1 | 9/2003 |
| GB | 2374616 | A | 10/2002 |
| WO | 96/11315 | A1 | 4/1996 |

* cited by examiner

FLOATING FLOOR

The invention relates to a floating floor with at least one vibration-damping support placed on a solid underground, whereby the support contains a relatively rigid support slat which is provided with discrete vibration-damping elements on one side, distributed across the support slat at a distance from one another, whereby the floor rests on the underground by means of the support slat and the discrete vibration-damping elements. The relatively rigid support slat thereby works in conjunction with the discrete vibration-damping elements so as to decouple the floor from the underground.

Such floating floors are used to acoustically decouple these floors from the underlying solid underground, such as building foundations and floor slabs. The floating floors are decoupled to avoid the transmission of vibrations from the environment on the one hand, and also to avoid the transmission of vibrations from the floating floor to the environment on the other hand.

This increases the comfort in a building and also reduces the risk of damage due to unwanted vibrations. The decoupling is achieved by making the floating floors rest on the elastic vibration dampers, metal springs, elastomer blocks or mats.

The elastomer blocks and mats may consist of polyurethane elastomers, natural rubber, neoprene rubber or other elastomers that are well known to the person skilled in the art for these applications.

The invention also relates to a support for a floating floor and a method for manufacturing such a floating floor.

According to the present state of the art, floating floors are specifically designed as a function of the expected load. The static and dynamic rigidnesses are specifically adapted to the loads to be absorbed and the acoustic requirements. For a sports floor in a sports hall, therefore, the expected activities that will take place on this sports floor must be taken into account. The requirements for these different activities will often be different. Activities such as dancing, gymnastics, fitness, medicine ball, weight lifting, bowling and various ball sports, for example, each have different impact energy levels that act on the floor.

As a result, the acoustic properties of a floating floor provided for a specific activity will not always be sufficient for other activities.

It is also important, of course, that the construction thickness of these floors remains acceptable.

Patent BE1008695A6 describes a floating floor with a vibration-damping support consisting of discrete vibration-damping elements with adapted static and dynamic rigidnesses. The floating floor is hereby mechanically fixed to parallel support slats by means of screws. The support slats rest on vibration-damping elements which are distributed at regular intervals, over the length of the support slat, and provided on the solid underground. The advantage of such an adapted floor is that, thanks to the efficient construction, a desired vibration and noise damping can be obtained that is sufficient for a specific application and/or activity. The disadvantage, however, is that this specific floor will be less suitable for other applications and/or activities.

The invention aims to remedy this by proposing a floating floor and a vibration-damping support, with a simple structure, which is universally applicable for a wide spectrum of impact energy levels, dynamic and static loads, and with which a good, uniform vibration and noise damping is obtained for this spectrum.

To this end, the invention proposes a support for the floating floor, whereby the support slat, on a second side opposite the first side, is provided with a vibration-damping strip extending in the longitudinal direction of the support slat, as set out in the appended claims.

Practically, the support slat is situated between the vibration-damping strip and the discrete vibration-damping elements placed between the floor and the underground, so that the floor rests on the underground by means of the vibration-damping strip, the support slat and the discrete vibration-damping elements, and so that there is no direct contact between the support slat, the floor and the underground. As there is no direct contact, vibrations are not transmitted without damping between the support slat, the floor and the underground.

Either the discrete vibration-damping elements are placed on the underground and the floor is placed on the vibration-damping strip with thus the strip between the floor and the slat, or the vibration-damping strip is placed on the underground and the floor is placed on the discrete vibration-damping elements, with thus the strip between the slat and the underground.

The floor is placed loosely on the support, resulting in a remarkably improved vibration and noise damping. The floor is thus placed without any gluing and/or mechanical fastening with, for example, clamps, nails and/or screws between the floor and the support.

Thanks to an elastic deformation of the elements and the strip, the support slat can move in relation to the floor and the underground.

As the floor is separate from the support, the floor can also move laterally in relation to the support.

Preferably, at least one anti-friction contact surface is provided between the floor and the vibration-damping support. This can be provided on the bottom side of the floor and/or on the vibration-damping support. Thus, the floor and the support preferably only make contact via the anti-friction contact surface.

The anti-friction contact surface ensures a reduced friction between the floor and the support compared to a classic structure where the floor is fixed to the support by means of gluing and/or mechanical fastening means such as clamps, screws and/or nails.

The anti-friction contact surface may be provided at least partly, for example, with a material reducing the friction, such as Teflon and/or textile fibres. In this manner, the rigidity of the contact surface can be increased to as to reduce the friction. Thus, the contact surface can be provided with a reinforcement layer to limit the elastic deformation of this contact surface. The reinforcement layer may consist, for example, of a textile layer, either or not woven. Preferably, the static coefficient of friction $\mu_s$ between the floor and the support is about 0.3 to 0.8, in particular 0.4 to 0.6.

In an advantageous manner, the discrete vibration-damping elements are distributed at a distance from one another over the entire length of the support slat.

In an advantageous manner, the vibration-damping strip extends over the support slat over a surface which is larger than a surface with which a discrete vibration-damping element extends over the support slat.

In a very advantageous manner, the vibration-damping strip extends over the support slat over at least two discrete vibration-damping elements. This ensures the stability of the support.

Preferably, the vibration-damping strip extends along the longitudinal direction of the support slat over mainly the full length of this support slat. As a result, the support slat is strengthened, and it also ensures the stability of the support.

The vibration-damping strip may possibly contain separate successive parts that connect to each other. Furthermore, the vibration-damping strip preferably extends between the floor and the support slat. Likewise, the vibration-damping strip is preferably provided with the anti-friction contact surface on which the floor rests. The vibration-damping may also have at least one supporting surface which is provided with a relief, in particular an uneven surface.

Multiple vibration-damping supports can be placed almost parallel to each other on the underground for the floor to rest on. Preferably, also the floor only rests on the supports.

In an interesting manner, the vibration-damping strip has at least one supporting surface which rests against the support slat, the floor or the underground, and which is provided with a relief, such as a corrugated surface. This improves the interaction between this supporting surface and the support slat, the floor or the underground against which it rests.

In a very interesting manner, the relatively rigid support slat has two upright flanges between which the vibration-damping elements are placed and/or two upright flanges between which the vibration-damping strip is placed.

In an extremely interesting manner, no mechanical relatively rigid fastenings are provided between the relatively rigid support slat, the floor and/or the underground.

The invention also concerns a support for a floating floor whereby a relatively rigid support slat is provided with discrete vibration-damping elements on one side and with a vibration-damping strip on the opposite side thereof, whereby the vibration-damping elements are distributed at a distance from one another over, preferably, the entire length of the support slat, whereby the vibration-damping strip extends in the longitudinal direction of the support slat over mainly the entire length of this support slat, whereby the vibration-damping elements and the vibration-damping strip are provided so as to rest on a solid underground or so as to support a relatively rigid floor plate of a floor, whereby the floor makes no direct contact with the underground or the support slat, and the support slat does not make any direct contact with the underground either.

The invention also relates to a method for acoustically decoupling and installing a floating floor, in which the floating floor is placed loosely on supports on the underground without the floor making direct contact with the underground, in which the supports are built with a support slat which is placed such that it can move between discrete vibration-damping elements and a vibration-damping strip, in which the elements and the slat are made to rest against the support slat on the one hand, and against the floor or the underground on the other hand, in which the support slats of the supports can move in relation to one another, the underground and the floor by elastically deforming the elements and/or the strips of the supports.

Other particularities and advantages of the invention will become clear from the following description of practical embodiments of the method and the device according to the invention; this description is given as an example only and does not limit the scope of the claimed protection in any way; the reference numbers used below refer to the accompanying figures.

Figure 1:
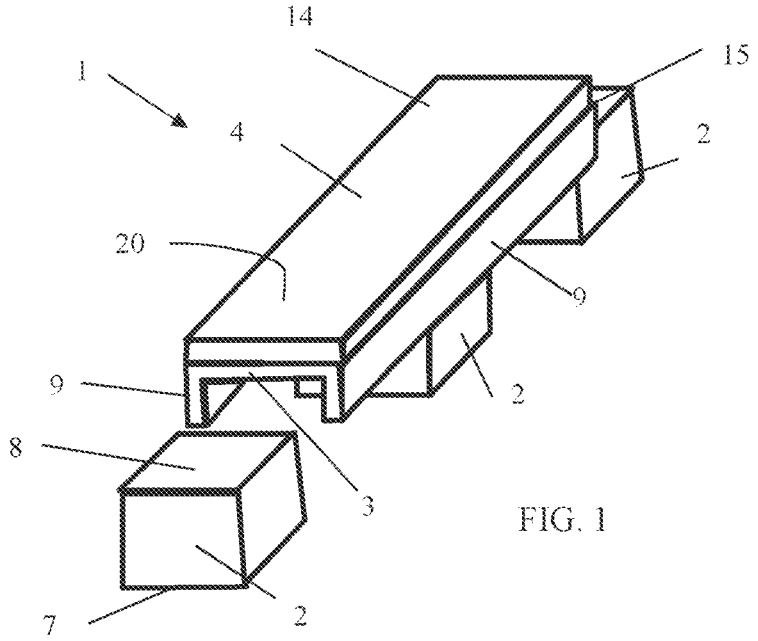
FIG. 1 is a schematic representation of a support with a support slat, discrete vibration-damping elements and a vibration-damping strip according to a first embodiment whereby the discrete vibration-damping elements are placed between upright flanges of the support slat and are provided so as to rest on a solid underground, whereas the strip is provided so as to support the floor.
Figure 5:
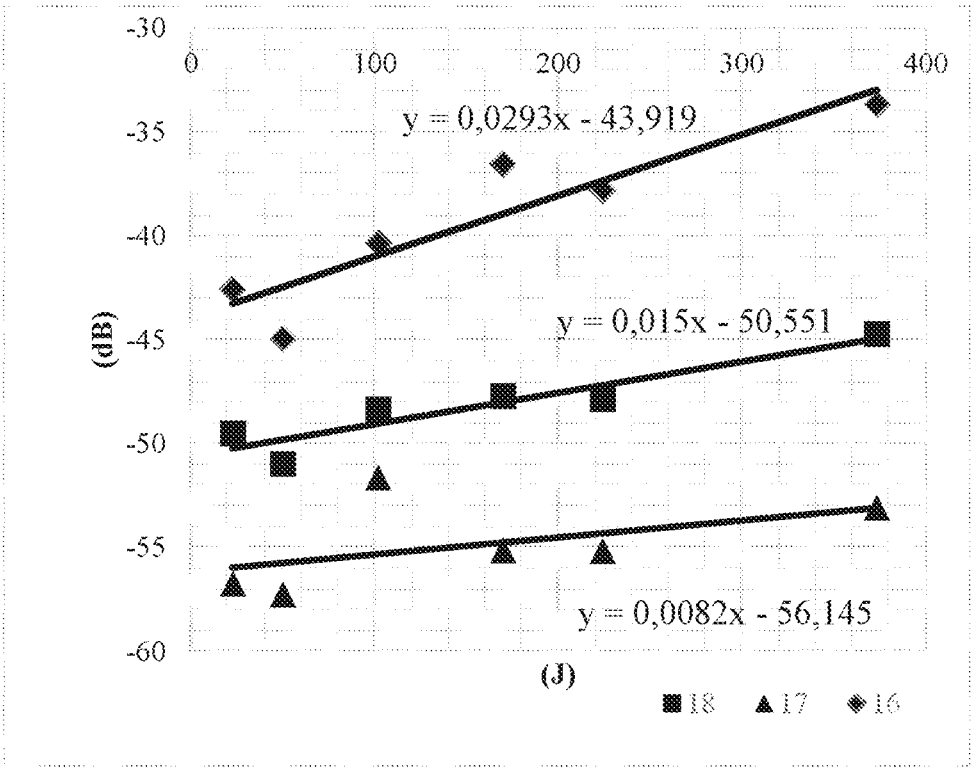

FIG. 5 is a graph of the result of an acoustic test in which the noise reduction (dB) (Y-axis) with respect to a floor without any acoustic decoupling is shown as a function of the impact energy level (J) (X-axis) on the test floor for: —▲— 18 an acoustically decoupled floating test floor provided with supports with vibration-damping strips, as in FIG. 1; —■— 17 a floating test floor with supports without said strips; —◆— 16 a floating test floor with a solid elastic mat instead of the supports.

In the different figures, identical reference numbers refer to identical or analogous elements.

The invention in general relates to a floating floor which is provided with a support with discrete vibration-damping elements and a vibration-damping strip with a support slat in between, by means of which the floating floor rests with a base plate on a solid underground.

The discrete vibration-damping elements and the vibration-damping strip are elastically deformable. The support slat and the base plate of the floor, however, are relatively rigid compared to the vibration-damping elements and strip.

The support ensures an acoustic decoupling of the underground and the floor above, thus preventing or limiting the transmission of vibrations. To this end, the floating floor, the support slat and the underground make no direct contact between them, so that they can move in relation to each other thanks to the elastic deformation of the discrete vibration-damping elements and vibration-damping strip in between. The floor is placed loosely on the support without being attached to it. Moreover, the static coefficient of friction between the floor and the support is preferably kept relatively low and is limited to a value of 0.3 to 0.8, and in particular 0.4 to 0.6. Because of the structure of the support, the support slats of neighbouring supports can preferably also move in relation to each other. Preferably, the floor can hereby also move freely in relation to the adjacent walls. The floor may also have a limited lateral movement in relation to the supports thanks to a relatively low friction between the floor and the support.

Figure 2:
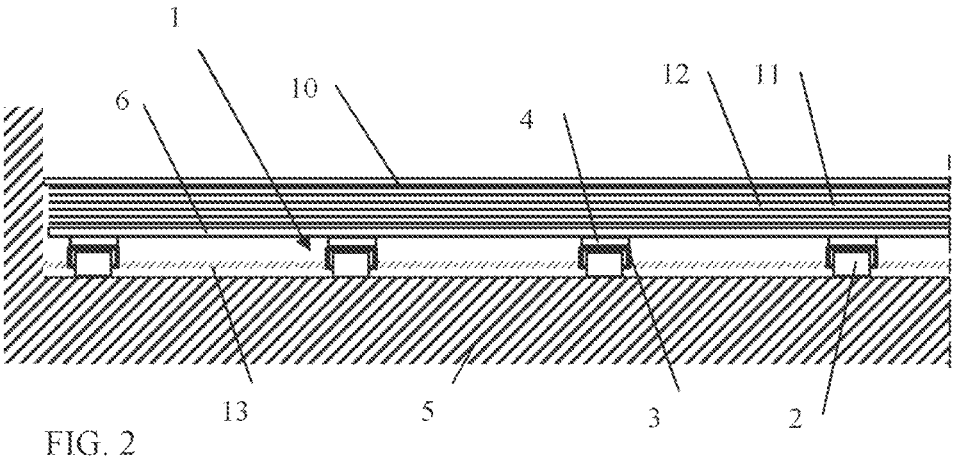
FIG. 2 is a schematic representation of a cross section of a floating floor provided with supports as in FIG. 1.

A first embodiment of a floating floor with support is represented in FIGS. 1 and 2.

The supports 1 are mainly built here of discrete vibration-damping elements 2, a support slat 3 and a vibration-damping strip 4.

On the solid underground 5 are placed discrete vibration-damping elements 2. These include elastomer blocks such as, for example, natural rubber or cork rubber. These can be prism or cube-shaped. A horizontal support slat 3 extends over the elements 2. Preferably, the elements 2 are centred with respect to the longitudinal axis of the support slat 3. The elastomer blocks each have two supporting surfaces 7 and 8. A first supporting surface 7 connects to the underground 5, and an opposite second supporting surface 8 connects to the bottom side of the support slat 3. The support slat 3 further has two upright flanges 9 on the bottom side, in between which the elastomer blocks of the elements 2 are situated. The elements 2 may possibly be clamped between these flanges 9. Thus, the support slat 3 may for example consist of a metal U or C profile. The height of the upright flanges 9 is lower than the height of the elements 2, so that there can be no direct contact between these elements 2 and the underground 5. The elements 2 are further distributed over the full length of the support slat 3, at regular distances from each other. Since the elements 2 are situated at a distance from each other, they make no direct contact with each other.

On the top of the support slat 3 is provided a vibration-damping strip 4 which extends over the full length of the support slat 3. The strip 4 connects with a first supporting surface 15 against the support slat 3. The strip 4 may consist of several connecting parts that are in line with each other. Preferably, the strip 4 is centred in relation to the longitudinal axis of the support slat 3. The vibration-damping strip 4 and the support slat 3 mainly extend horizontally over the underground 5.

At the supports 1, the discrete vibration-damping elements 2 are preferably centred with respect to the longitudinal axis of the strip 4.

In this way, several such supports 1 are provided on the underground 5 in this embodiment, preferably parallel to each other and at a distance from each other, regularly distributed over said underground 5. The distance between these two supports 1 may, for example, correspond to the distance between two elements 2. The elements 2 are hereby regularly distributed over the underground 5.

Further, between the supports 1 and/or the elements 2 can be applied vibration-damping material 13 such as, for example, mineral wool.

On top of the vibration-damping strips 4 of the supports 1, the floating floor 10 is placed. A relatively rigid base plate 6 hereby rests on the strips 4 without making contact with the support slat 3 and/or the underground 5. The strip 4 has a second supporting surface 14 on the side opposite the side of the first supporting surface 15. The second supporting surface 14 in this embodiment connects to the base plate 6.

As the strip 4 extends over the full length of the support slat 3, the load is distributed over the support slat 3 and a good interaction with the floor 10 is obtained, which ensures the stability of the support 1.

The floor 10 lies loosely on the strip 4. The contact surface 20 of the second supporting surface 14 of the strip 4 on which the floor 10 rests directly with the base plate 6 moreover ensures a low friction between the base plate 6 and the strip 4. The static coefficient of friction between the strip 4 of the support 1 and the base plate 6 of the floor 10 hereby preferably amounts to 0.4 to 0.6.

The desired coefficient of friction between the contact surface 20 of the strip 4 and the floor 10 can be obtained in different ways. Thus, the contact surface can be provided at least in part with a material that reduces friction, such as Teflon, textile fibre or other materials known to the person skilled in the art. The contact surface 20 of the strip 4 can also be made extra smooth. This way, the contact surface on the outside of the strip 4 can be made more rigid than the inside of the strip 4. Thus, the contact surface can be provided with a reinforcement layer to restrict the elastic deformation of this contact surface. The reinforcement layer may consist, for example, of a textile layer, either or not woven.

The selection of the static coefficient of friction between 0.3 and 0.8, or more specifically between 0.4 and 0.6, allows to obtain a substantially improved vibration damping while still maintaining a workable minimal resistance for the installation of the floor 10 on the supports 1.

The floating floor 10 is made up of alternating horizontal layers of relatively rigid plates 12 and flexible plates 11. The top side of the floor 10 is finished with materials known as such, depending on the desired application of this floor 10.

Figure 3:
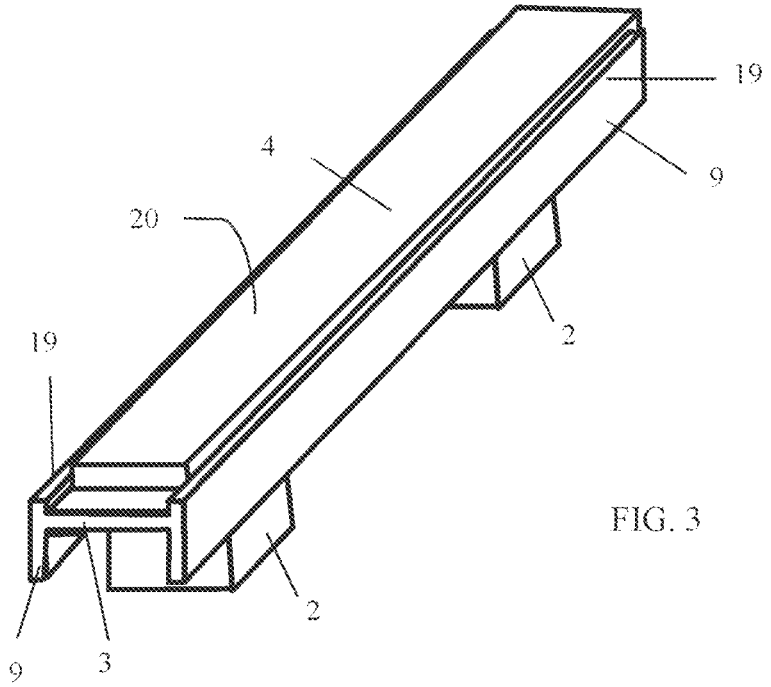
FIG. 3 is a schematic representation of a support according to a variant of the first embodiment as in FIG. 1, whereby also the vibration-damping strip is placed between two upright flanges of the support slat.

A variant of the first embodiment is represented in FIG. 3 and differs in that the support slat 3 is also provided with upright flanges 19 in between which the vibration-damping strip 4 extends and in between which the strip 4 can possibly be clamped. The height of these upright flanges 19 is lower than the thickness of the strip 4, so that there is no direct contact with the floor 10.

Figure 4:
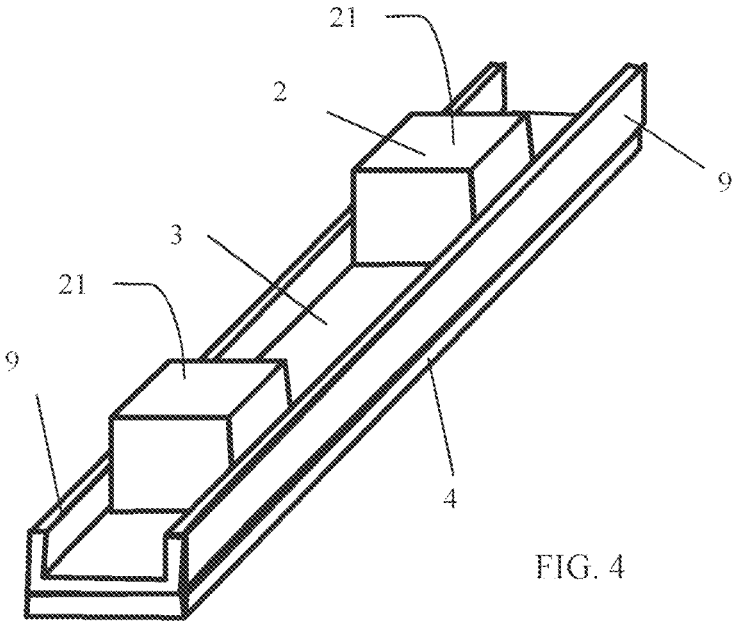
FIG. 4 is a schematic representation of a support as in FIG. 1, whereby the support is rotated 180°, such that the vibration-damping strip is provided so as to rest on the solid underground, whereas the discrete elements are provided to connect to the floor and support the latter.

A support 1 according to a second embodiment, represented in FIG. 4, differs from the first embodiment in that the support is rotated 180° over its longitudinal axis. The vibration-damping strip 4 hereby rests on the underground 5, while the base plate 6 of the floor 10 rests directly on the elements 2. The elements 2 are hereby provided with a contact surface 21 on which the floor 10 rests and which, preferably, ensures a low friction between the floor 10 and the elements 2.

A third embodiment, not represented in the figures, differs from the first embodiment in that the vibration-damping strip 4 is made of different parts that are in line with each other but do not connect. The parts hereby extend on the support slat 3 over a surface which is larger than the supporting surface 8 of a vibration-damping element 2. One part preferably extends over at least one vibration-damping element 2. In particular, the parts hereby extend over at least two vibration-damping elements 2.

In the above-described embodiments, the vibration-damping strip 4 and the discrete vibration-damping elements 2 are preferably made of an elastomer. Thus, the elements 2 are preferably solid elastomer blocks, and the strips 4 are preferably solid elastomer strips. The type and composition of the elastomer can be selected as a function of the desired properties and loads of the floor 10 and the support 1. Thus, these blocks can be made of rubber, cork rubber, polyurethane or other known elastomers.

The support slat 3 may consist of a wooden beam, plastic beam, composite wooden beam, metal profile, aluminium or galvanized steel profile, and has a relatively high bending resistance. The support slat may, for example, include a support profile with a so-called U, C, H or I-section.

Preferably, the discrete vibration-damping elements 2, the support slat 3, the vibration-damping strip 4 and the floor 10 are placed loosely on top of each other, and no mechanical fasteners such as screws are provided. In an advantageous manner, the vibration-damping elements 2 and/or the vibration-damping strip 4 are laterally clamped between upright flanges of the support slat 3.

The vibration-damping elements 2 and the strip 4 may optionally be attached to the support slat 3 by techniques known as such, such as vulcanization, mechanical clamping and/or gluing with known adhesives such as, for example, polyurethane adhesive. If necessary, they can also be glued to the underground 5.

The floor as such is thus, preferably, composed of several continuous horizontal layers of alternately flexible elastic layers and rigid layers. The rigid layers may consist of wooden boards such as plywood boards, wood fibre boards, wood chip boards, OSB boards or MDF boards. The flexible layers may consist, for example, of elastomer mats, rubber and/or cork layers.

Preferably, the combination of a layered structure of the floor 10 and the loose placement on the supports 1 also contributes to an even vibration and noise reduction for a wide spectrum of impact energy levels and dynamic and static loads.

As an example, an acoustic test is discussed below in which the noise (dB) produced by an impact on a test floor is measured in different test setups under this test floor. Unless otherwise stated, the different parts out of which the test floor with support is composed, are placed loosely on top of each other without any glue and/or mechanical fastenings such as clamps, nails and/or screws. In the tests, different weights are dropped from different heights on the test floor. This results in different impacts on the test floor with different energy levels (Joule (J)).

The structure of the floor 10 with the support 1 in the test setups is as follows, from top to bottom:

| | Type | height |
|---|---|---|
| floor 10: | | |
| flexible top layer | rubber sports floor | 10 mm; |
| flexible board 11 | granulate rubber mat | 20 mm; |
| relatively rigid board 12 | plywood | 19 mm; |
| flexible board 11 | rubber mat | 10 mm; |
| relatively rigid board 12 | plywood | 19 mm; |
| flexible board 11 | rubber mat | 10 mm; |
| relatively rigid base plate 6 | plywood | 19 mm; |
| support 1: | | |
| vibration-damping strip 4 | rubber (82.55 mm wide) | 10 mm; |
| support slat 3 | C profile (82.55 mm wide) | ; |
| discrete vibration-damping elements 2 | rubber block (50 mm wide, 50 mm long and 50 mm high) | 50 mm; |
| solid underground 5 | | , |

whereby the support is either or not provided with the vibration-damping strip 4.

In a first test setup, the supports 1 are placed parallel to each other, regularly distributed over the underground. The distance between the longitudinal axes of two consecutive, adjacent support slats is 609.6 mm. The support slat 3 is formed of a metal C profile whose flanges 9 are directed downwards so that the vibration-damping elements 2 are situated between the flanges 9, centred under the middle of the C profile. The discrete vibration-damping elements 2 are distributed over the length of the support slat 3. The distance between the middle of two consecutive elements 2 amounts to 609.6 mm. Consequently, the discrete vibration-damping elements 2 are regularly distributed over the underground 5.

The floor 10 is made up of various alternately flexible and rigid layers 11 and 12.

In the first test setup, the rigid base plate 6 rests on the vibration-damping strip 4 so that there is no direct contact between the floor 10 and the support slat 3. The strip 4 hereby extends over the full length of the support slat 3. In this first test setup, the support slat is not further attached to the base plate 6 and/or the floor 10.

The static coefficient of friction at the contact surface between the base plate 6 and the strip 4 is approximately 0.5.

A second test setup is identical to the first setup, save for the strip 4 which is not provided. The rigid base plate 6 rests on the support slat 3 of the support 1 without said vibration-damping strip 4. This base plate 6 is solidly fixed to the support slat 3 by means of screws.

A third test setup is built with a rigid base plate 6 which rests with its entire surface on a solid elastic mat, without any supports 1.

The test consists in dropping different weights from different heights on the test floors of the test setups. The noise level (dB) due to the impact is measured under the test floor for the different setups. The noise reduction (dB) is obtained by comparing the measured noise level with the noise level in a test when no floating floor is installed. To this end, the measured noise without a floating floor is subtracted from the measured noise with the floating floor. The noise reductions 16, 17 and 18 in the different test floors, for different combinations of heights, from 0.2 m to 1.5 m, and weights, from 10 kg to 25 kg, which correspond to different impact energy levels, between 20 J and 400 J, from the impact on the test floor, are represented in FIG. 5. The graph of FIG. 5 shows the noise reduction in decibel (dB) on the vertical Y axis, whereas the energy level of the impact in Joule (J) is shown on the horizontal X axis.

The noise reduction of the test results 17 in the first setup with the vibration-damping strip 4 is 5 to 8 dB higher than the noise reduction of the test results 18 in the second setup without said strip 4. The noise reduction 16 in a floor construction without the supports 1 in the third test setup is also much smaller at higher energy levels than at lower energy levels. It should be noted that for each of these impact energy levels, providing the strip 4 results in an almost equal improvement of the noise reduction, independent of these energy levels.

From the linear regressions shown in FIG. 5 for the three different series of test results, it can be clearly deduced that in the first series of test results 17, the noise reduction is less dependent on the energy level of the impact than in the second and third series of test results 16 and 18. A smaller directional coefficient indicates that the noise reduction is less dependent on the energy level of the impact.

Providing the strips 4 has the same or even a better sound-damping effect as providing a complete additional vibration-damping flexible intermediate layer 11 and a rigid layer 12, although a much smaller mass is added to the floating floor and thus also much less material is needed for the strips 4 than for an additional intermediate layer 11. Moreover, there is no need to provide an additional rigid layer 12, as a result of which the total building height of the floor and the support will not increase.

By applying the vibration-damping strip 4 to the support 1 at this specific location and by, preferably, placing the floor 10 loosely on the support, moreover with preferably a reduced friction between the bottom side of the floor 10 and the support 1, a significant additional damping is obtained, with only a limited increase in the building height and with only a limited addition of mass to the floating floor 10 system with support 1. Alternatively, the same damping can also be obtained with a lower floor structure and floor mass, by providing this strip 4 and thereby reducing the number and/or the thickness of the floor layers.

Naturally, the invention is not restricted to the above-described methods and the embodiments represented in the accompanying figures. Thus, the various characteristics of these embodiments can be mutually combined.

Thus, the strip 4 may also consist of two parallel strips placed on the support slat 3. The strip 4 and/or the support slat 3 may have a profiled support surface to better absorb, for example, possible shear stresses or lateral loads. The floor 10 may also contain a reinforced concrete slab. The discrete vibration-damping elements 2 may consist at least partly of metal springs. The support 1 may be provided with a relatively rigid mounting slat on its top and/or bottom side, parallel to the relatively rigid support slat 3, whereby the mounting slat makes no direct contact with the support slat 3 as the vibration-damping strip 4 or the discrete vibration-damping elements 2 are situated in between. This mounting slat may, for example, be fixed on the underground 5 or it can be provided with the anti-friction contact surface between the floor 10 and the support 1.

The invention claimed is:

1. A floating floor with at least one vibration-damping support for sound damping, wherein the support rests on a solid underground, wherein the support comprises a relatively rigid support slat provided with discrete vibration-damping elements on a first side, distributed at a regular distance from each other in a longitudinal direction of the support slat, and wherein the support slat is provided with a vibration-damping strip on a second side opposite the first side and extending in the longitudinal direction of the support slat, wherein the floor rests loosely on the vibration-damping support.

2. The floating floor according to claim 1, wherein the support slat is situated between the vibration-damping strip and the discrete vibration-damping elements, which are placed between the floor and the underground, such that the floor rests on the underground by means of the vibration-damping strip, the support slat and the discrete vibration-damping elements, wherein no direct mutual contact is made between the support slat, the floor and the underground.

3. The floating floor according to claim 1, wherein the discrete vibration-damping elements, the support slat, the vibration-damping strip and the floor are loosely placed on top of each other.

4. The floating floor according to claim 1, wherein the floor is placed laterally movable in relation to the support.

5. The floating floor according to claim 1, wherein the vibration-damping support and the floor make contact with each other via at least one anti-friction contact surface provided on the bottom side of the floor and/or on the vibration-damping support.

6. The floating floor according to claim 5, wherein the anti-friction contact surface is provided on the vibration-damping strip.

7. The floating floor according to claim 1, wherein the static coefficient of friction between the vibration-damping support and the floor amounts to 0.3 to 0.8.

8. The floating floor according to claim 1, wherein the discrete vibration-damping elements are placed on the underground, and the floor is placed on the vibration-damping strip.

9. The floating floor according to claim 1, wherein the floor is layered and contains at least one rigid base plate which rests directly on the vibration-damping strip.

10. The floating floor according to claim 1, wherein the relatively rigid support slat comprises a support profile selected from a C profile, U profile, H profile or I profile, or combinations thereof.

11. The floating floor according to claim 1, wherein the relatively rigid support slat has two upright flanges in between which the vibration-damping elements are placed, and/or two upright flanges in between which the vibration-damping strip is placed.

12. The floating floor according to claim 11, wherein the vibration-damping elements and/or the vibration-damping strip are laterally clamped between the upright flanges of the support slat.

13. The floating floor according to claim 1, wherein the vibration-damping strip and/or the discrete vibration-damping elements contain at least one elastic block made of an elastomer.

14. A method for acoustically decoupling and installing a floating floor, wherein the floor rests on an underground by means of vibration-damping supports, wherein the vibration-damping supports are formed of a relatively rigid support slat provided with discrete vibration-damping elements on a first side which are distributed at a distance from each other extending in a longitudinal direction of the support slat, and provided with a vibration-damping strip on a second side opposite the first side extending in the longitudinal direction of the support slat, wherein the floating floor is placed loosely on the vibration-damping supports.

15. The method according to claim 14, wherein the floor is placed laterally movable on the supports.

16. The method according to claim 14, wherein the floor is made to rest on the support by means of a contact surface between this floor and said support, selected in order to obtain a static coefficient of friction between said floor and said support which amounts to 0.3 to 0.8.

17. The method according to claim 14, wherein the elements are placed on the underground, and the floor is placed loosely on the strips of the supports.

18. The method according to claim 14, wherein the supports with strip, support slat and elements are placed between the floor and the underground so as to obtain a noise reduction of 5 to 8 dB with impact energy levels between 20 J and 400 J.

19. The method according to claim 14, wherein the strips are placed over a full length in the longitudinal direction of the support slats.

20. The method according to claim 14, wherein the support slats are provided with upright flanges in between which the strips and/or the elements are placed.

21. The method according to claim 20, wherein the strips and/or the elements are clamped between said flanges.

22. The method according to claim 14, wherein the floating floor is built of a layered structure containing alternately relatively rigid and flexible layers.

23. The method according to claim 14, wherein the floating floor is provided with a relatively rigid base plate which is made to rest on the supports.

* * * * *